US008950332B1

(12) United States Patent
Iden et al.

(10) Patent No.: US 8,950,332 B1
(45) Date of Patent: Feb. 10, 2015

(54) EXPANDING NON-LETHAL MUNITION

(71) Applicants: Daniel E. Iden, Sparta, NJ (US); Colin M. Smith, Morristown, NJ (US); Ryan T. Hooke, Sparta, NJ (US); Yao H. Chen, Brooklyn, NY (US)

(72) Inventors: Daniel E. Iden, Sparta, NJ (US); Colin M. Smith, Morristown, NJ (US); Ryan T. Hooke, Sparta, NJ (US); Yao H. Chen, Brooklyn, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/031,149

(22) Filed: Sep. 19, 2013

Related U.S. Application Data

(60) Provisional application No. 61/702,866, filed on Sep. 19, 2012.

(51) Int. Cl.
*F42B 8/00* (2006.01)
*F42B 12/60* (2006.01)

(52) U.S. Cl.
CPC ..... *F42B 12/60* (2013.01)
USPC ..... 102/498

(58) Field of Classification Search
CPC ..... F42B 8/26
USPC ..... 102/498, 368
See application file for complete search history.

(56) References Cited

U.S. PATENT DOCUMENTS

| | | | | |
|---|---|---|---|---|
| 4,932,329 | A * | 6/1990 | Logie | 102/498 |
| 5,996,503 | A * | 12/1999 | Woodall et al. | 102/498 |
| 6,581,521 | B1 * | 6/2003 | Dixon et al. | 102/368 |
| 8,485,101 | B2 * | 7/2013 | Frank | 102/498 |

* cited by examiner

*Primary Examiner* — Reginald Tillman, Jr.
(74) *Attorney, Agent, or Firm* — Henry S. Goldfine

(57) ABSTRACT

A non-lethal, hand or rifle fired grenade which widely disperses non-lethal pellets—using a flexible multipocket bladder type device which is mounted on a rigid internal frame. The grenade provides a wide distribution arc of rotation for the pellets, as the pellets are located in pockets about the bladder, which is blown outward to expel the pellets. Further, as the propellant is located within the flexible multipocket bladder, the hot gases and embers cannot escape—thereby helping to protect the target individuals from exposure to such potentially hazardous materials.

5 Claims, 4 Drawing Sheets

Expanding Multipocket Grenade

Cross-Section

Flexible Multipocket Form
Or Bladder

Expanding Multipocket Grenade

Cross-Section

Internal Grenade Frame
Covered by Flexible Multipocket Form

FLEXIBLE MULTIPOCKET FORM (BLADDER)
SHOWN AFTER IGNITION OF PROPELLANT
WITH REPRESENTATIVE PELLETS BEING EXPELLED

EXPANDING NON-LETHAL MUNITION

CROSS REFERENCE TO RELATED APPLICATION

This application claims the benefit of U.S. Provisional Patent Application Ser. No. 61/702,866 filed Sep. 19, 2012 which is incorporated by reference as if set forth at length herein.

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of non-lethal munitions, and more specifically, to a grenade type device that utilizes an expanding flexible multipocket form to uniformly expel either solid or marking pellets.

BACKGROUND OF THE DISCLOSURE

There are various non-lethal weapons systems utilized by the U.S. armed services to provide force protection in non-battlefield situations, such as against civilians in riot or crowd control situations—where lethal or destructive force is contra-indicated. One particular such device is fired from a tube mounted atop light vehicles and it is designated as the light vehicle obscuration smoke system or LVOSS—which provides a low toxicity protective smoke in combination with anti-riot grenades. A particular such anti-riot grenade is designated as the M99 Blunt Trauma Grenade, which grenade uses a pyrotechnic charge to discharge 32 rubber balls and achieve crowd control through physical stimuli. The M99 Blunt Trauma Grenade is cylindrical in configuration with the rubber balls packed about a propellant core—such that upon ignition of the core, the balls will be propelled outwardly in the cylindrical pattern, along with the hot fragments and gasses from the ignited propellant.

An alternative non-lethal U.S. military weapon system to the tube fired LVOSS, is a hand thrown grenade termed the XM 104 non-lethal bursting hand grenade (NLBHG)—a grenade intended for use in relatively confined spaces; wherein, the grenade releases a shower of from 100 to 130 pellets to sting and disorient any individuals located in the subject space. However, similar to the LVOSS, the pellets in the NLBHG are directly packed in a cylindrical pattern, along the length of a central propellant containing tube or cylinder,—such that when the propellant is ignited and detonates, the pellets will be ejected in a generally in cylindrically pattern from the NLBHG, along with the exploding propellant gases and hot embers.

Another alternative U.S. military non-lethal device is the M5 Crowd Control Munition (MCCM)—which is configured and used in a manner similar to the M18A1 Claymore Mine, i.e. an elongated parallelepiped, that is ground mounted, and designed to direct the explosive force in the direction of the front face of the parallelepiped. While the Claymore ejects lethal fragments from its face, the MCCM ejects about 600 high velocity rubber balls from its face, with a significant percussion and flash, along with hot propellant gases and embers of the propellant. Due to these hot gases and embers and the initial velocity of the rubber balls—the minimum safe distance from the face of the MCCM is 5 meters. Further, while the MCCM is effective up to about 30 meters—it is only effective in a 60 to 80 degree horizontal arc (dispersion arc) from its face.

There is a need in the art for an effective non-lethal military device that has a greater dispersion than the cylindrical patterns or limited dispersion arc of the prior art, while also providing a means to prevent the targets from exposure to hot gases and embers—which can cause significant injury.

SUMMARY OF THE DISCLOSURE

The present invention overcomes the problems of the prior art with respect to a safe, non-lethal, hand or rifle fired munition, which munition is preferably a grenade which widely disperses non-lethal pellets. The inventive grenade is formed of (1) a rigid internal grenade frame, having an upper and lower hoop and a plurality of 3 or 4 vertical bars spacing said hoops apart; (2) a flexible multipocket form (i.e. a "bladder") that fits about said rigid internal frame, (3) which flexible form is in the general shape of an hourglass, which form provides the inventive grenade expanding body; (4) wherein said hourglass form has an upper conical section and a lower conical section, aligned along a central elongated axis—with a short, central cylindrical section therebetween; (5) the sides of said hourglass having a plurality of walls extend therefrom, which walls extend to and about the vertical bars spacing said rigid frame hoops apart; (6) whereby, a plurality of pockets are formed by and between the flexible walls and the central cylindrical section, (7) which pockets are packed with pellets, powder or fluids, as is the upper conical section; (8) which pellets are preferably either solid impact-type balls or filled marker-type balls; and (9) wherein the lower conical section contains a fuze and propellant; (10) such that, when the grenade fuze is activated and the grenade delivered to its target—the propellant in the lower conical section will be ignited and explode, and the flexible multipocket form will be expanded by the explosion and the propellant's expanding gases, such that the pellets will be ejected in a wide distribution about the grenades center—against the desired targets, and (11) the ignition by-products are contained within the flexible multipocket for (whereby, the explosive gases, sparks and embers, and any and all explosive by-products are contained, so as not to impact upon any target individual(s)). The wide distribution of the non-lethal pellets is over a very wide distribution arc-of-rotation, i.e. an arc-of-rotation greater than 300 degrees spherically about the center point of the central cylindrical section (i.e. the centerpoint of the subject inventive grenade).

BRIEF DESCRIPTION OF THE DRAWING

A more complete understanding of the present disclosure may be realized by reference to the accompanying drawings in which.

DETAILED DESCRIPTION OF PREFERRED EMBODIMENT

The following merely illustrates the principles of the disclosure. It will thus be appreciated that those skilled in the art will be able to devise various arrangements which, although not explicitly described or shown herein, embody the principles of the disclosure and are included within its spirit and scope.

Figure 4:
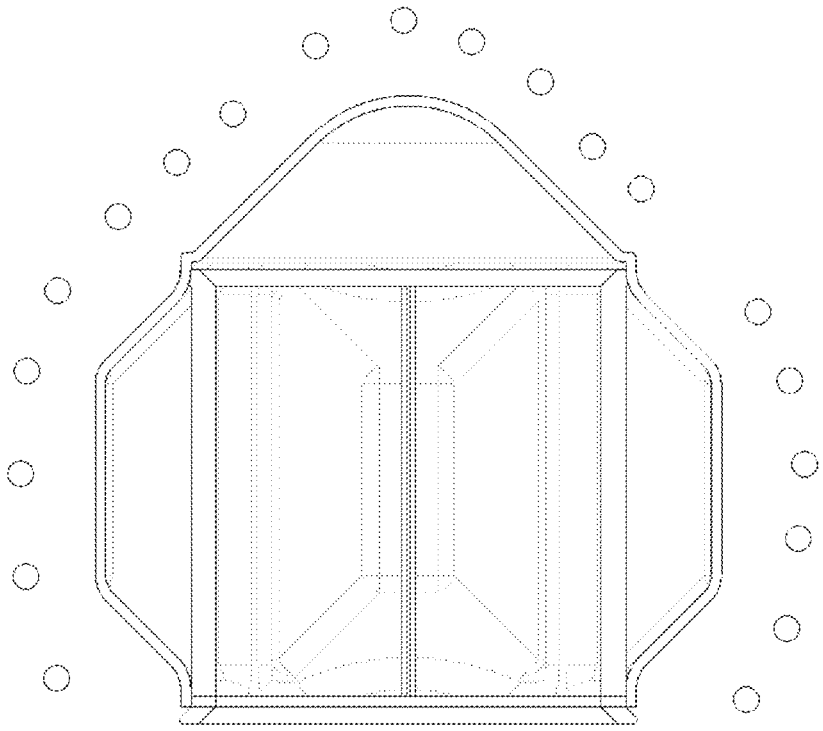
FIG. 4 is a diagram of a preferred embodiment of the subject inventive expanding non-lethal munition, showing the flexible multipocket form, or bladder, immediately after the propellant has been exploded—such that the bladder is extended and the pellets have been ejected (a representative number of pellets are shown being expelled).

As detailed above, the present invention provides a safe, non-lethal, hand or rifle fired munition, which munition is preferably a grenade, which grenade widely disperses non-lethal pellets. The inventive grenade is formed of a rigid internal grenade frame that supports a flexible multipocket form that fits about the rigid internal frame. The flexible form is in the general shape of an hourglass, which has an upper conical section and a lower conical section, aligned along a central elongated axis—with a short, central cylindrical section therebetween. The sides of the hourglass have a plurality of walls extends to and about the vertical bars about the periphery of the rigid internal grenade frame. Whereby each set of adjacent walls and the section of the central cylindrical section therebetween, form a plurality of pocket. The pockets are preferably packed with pellets, as is the upper conical section—which pellets are preferably either solid impact-type balls or filled marker-type balls. A fuze and a propellant charge are housed in the lower conical section; such that, when the grenade fuze is activated and the grenade delivered to its target—the propellant in the lower conical section will be ignited and explode, and the flexible multipocket form will be expanded by the explosion and the propellant's expanding gases, such that the pellets will be ejected (as shown in FIG. 4) with significant force, in a wide distribution arc about the grenades center to impact the desired targets. Importantly, the ignition by-products are contained within the flexible multipocket form—to prevent injury to any target thereby. And, also importantly, the wide distribution of the non-lethal pellets is over a very wide distribution arc-of-rotation, i.e. an arc-of-rotation greater than about 300 degrees spherically about the center point of the central cylindrical section.

Figure 3:
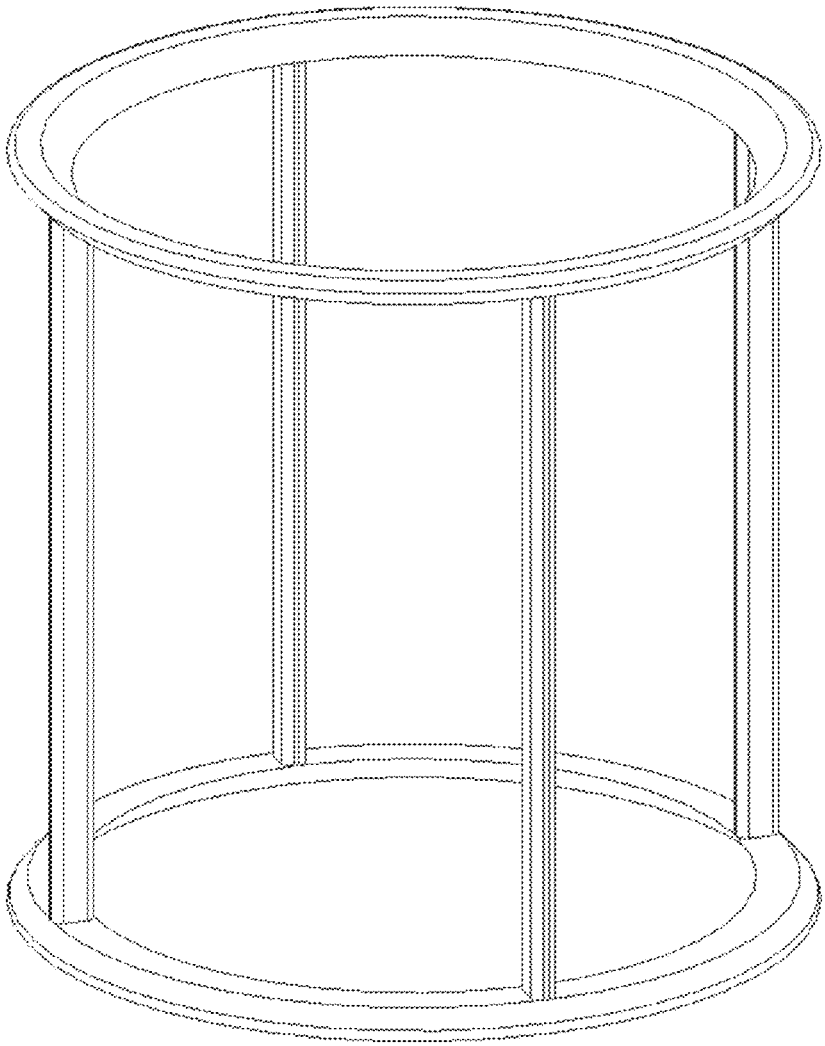
FIG. 3 is a diagram showing the interior frame of the present invention—about which frame the flexible multipocket frame is mounted—the interior frame providing structure to the flexible multipocket frame (which holds the pellets, or powder or fluid and which is expanded by the propellant to eject same)

The rigid internal grenade frame as shown in FIG. 3 is preferably manufactured of a lightweight metal—such as aluminum, or magnesium, or alloys thereof—or plastics. Use of such a preferred material will provide the rigidity and strength required to support the flexible multipocket form which is mounted on the rigid internal grenade frame; while, not adding significant weight to the inventive expanding munition. Minimizing the weight is critical, as the subject munition must be physically carried by the soldier—in addition to a complete personal protective and weapons kit.

The flexible multipocket form or bladder is preferably manufactured of molded silicone, or of a thermoset rubber, or of a thermoplastic elastomer, or of an impermeable woven type fabric capable of severe deformation before rupture, or alternative flexible material which can be formed to retain the desired multipocket form. Further, preferably, the hourglass shape of the flexible multipocket form has a hollow core—such that it can be physically flexed inside-out and fit about the rigid internal skeleton, as a sock is turned inside-out and fit about a foot. And, importantly, the flexible multipocket form will provide enough of a barrier to withstand the propellant's potential energies released and explosive force of the propellant force ejecting the balls from the pockets thereabout, and to function as a barrier to prevent the explosive gases, sparks and embers, and explosive by-products from reaching the individual(s) who are the target of the pellets, or thixotropic fluids, or powders.

To achieve the desired non-lethal deterrent effect—the present invention will eject the pellets, i.e. solid or hollow-paint ball type projectiles, fluids or powders—preferably at a velocity of at least about 50 mph, preferably at least 60 mph and up to about 200 mph, i.e. the maximum safe velocity of considered for paintball projectiles. To achieve such velocity, the propellant can be a few grams of black powder or secondary explosive—which can be ignited by a timed or other standard grenade fuze. Fluids could consist of the mall odorant type to colored water where powder size must remain above the inhalation hazard sizes, but could be as simple as sand or talcum powder.

Figure 1:
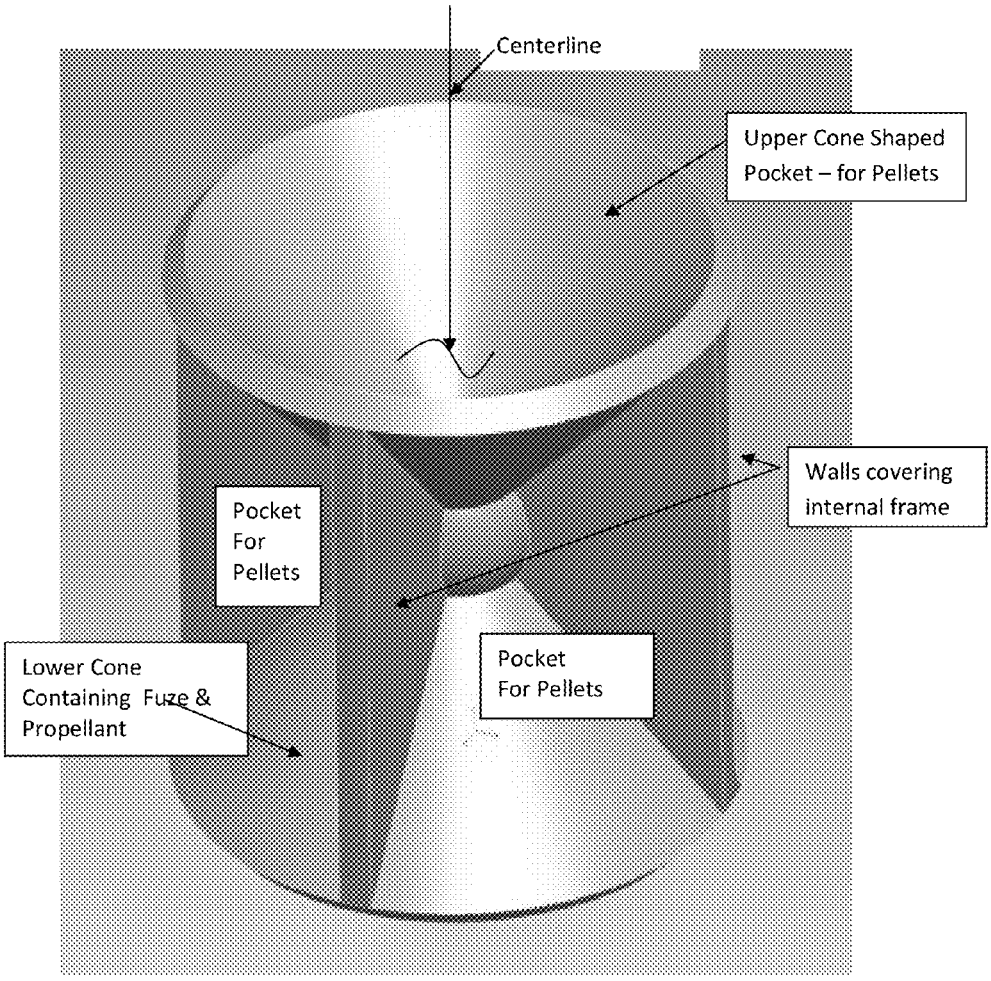
FIG. 1 is a perspective diagram of a representative flexible multipocket form, or bladder, of the present invention.
Figure 2:
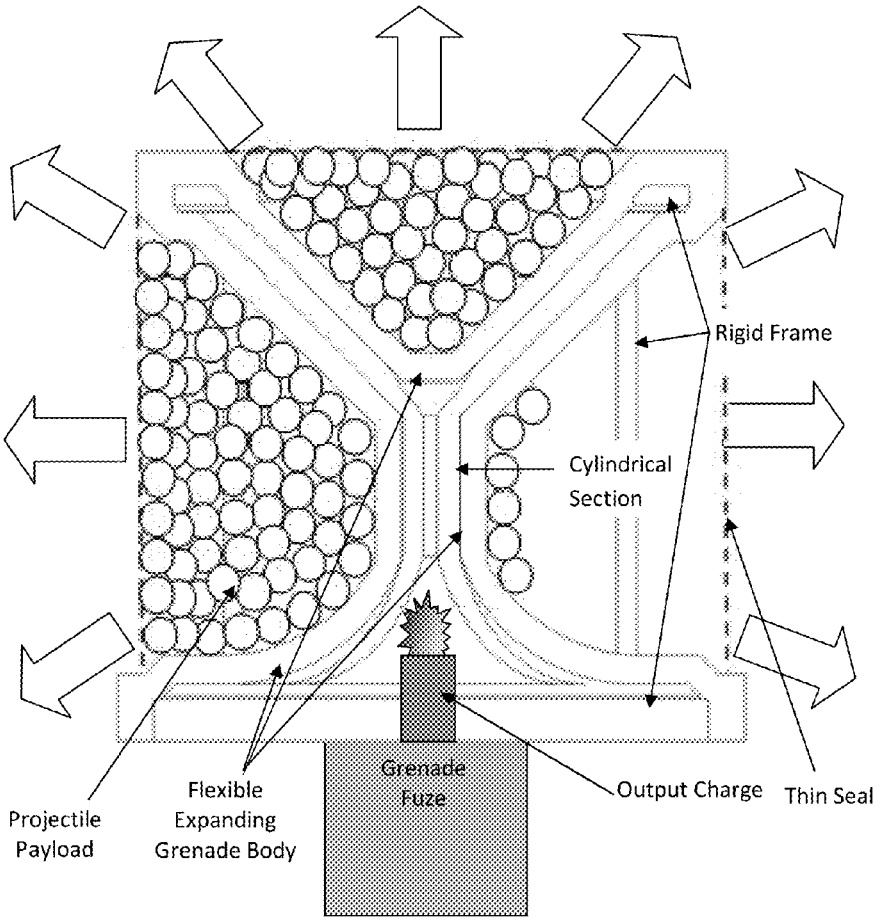
FIG. 2 is a cross-sectional rendition of an embodiment of the expanding multipocket flexible form of the present invention—showing the general hourglass shape of the expanding grenade body, with the top cone section filled with pellets, i.e. solid balls, the left side pocket filled and the right side pocket partially filled (though of course, in use, the right side pocket would be totally filled with said pellets). Note: the right side pocket is shown with only a few representative pellets—so that the vertical interior frame member can be and is shown therein.

As detailed above, and indicated in FIGS. 1 and 2, the pockets and the upper cone are filled with pellets—and to keep these pellets in-place, a thin plastic membrane, or seal, can preferably be used to encase the entire set of pockets and the upper cone. This thin membrane or thin seal can preferably be manufactured of a plastic wrap type material—such as polyvinyl chloride (PVC), or low density polyethylene (LDPE), or polyvinylidene chloride, or similar type material. There is no need for this membrane to have significant structural strength—as the rigid internal grenade frame is providing such integrity. Further, the entire rigid internal grenade frame and flexible multipocket frame with pellets—is all encased in a rigid grenade body (using known materials and technology).

With respect to specific embodiments of the subject invention, FIG. 2 shows the cross-section of such an embodiment—showing the generally hourglass shape of the flexible expanding grenade body—with the upper cone shaped section or pocket filled with pellets, the right side pocket filled with pellets and the left side pocket partially filled with pellets (in a representative manner—so, that the rigid frame member can be seen in this particular cross-section). In normal use the right side pocket would be filled with pellets and the unseen pocket(s) in the rear would also be so filled. Further, the arrows about the FIG. 2 cross-section, show the fact that as the flexible expanding grenade body or bladder are forced outward by the ignition of the output charge—the pellets will be distributed in all directions about the grenade (except, in the general location of the fuze and output charge).

At this point, while we have discussed and described the invention using a preferred embodiment, those skilled in the art will recognize that our teachings are not so limited. Accordingly, the invention should be only limited by the scope of the claims attached hereto.

The invention claimed is:

1. A non-lethal grenade, comprising:

(a) a rigid internal grenade frame, having an upper and a lower hoop and a plurality of 3 or 4 vertical bars spacing said hoops apart;

(b) a flexible multipocket form that fits about said rigid internal frame, (c) which flexible form is in the general shape of an hourglass;

(d) wherein said hourglass form has an upper conical section and a lower conical section, aligned along a central elongated axis, with a short, central cylindrical section also aligned along said central elongated axis and located between said upper and lower conical sections;

(e) the sides of said hourglass having a plurality of walls extend therefrom, (f) which walls extend to and about the vertical bars;

(g) whereby, a plurality of pockets are formed by and between the flexible walls and the central cylindrical section, (h) which pockets are packed with at least one of pellets, a powder, or a fluid;

(i) said upper conical section is packed with at least one of pellets, a powder, or a fluid;

(j) wherein the lower conical section contains a fuze and propellant;

(k) such that, when the grenade fuze is activated and the grenade delivered to its target, the propellant in the lower conical section will be ignited and explode, and the flexible multipocket form will be expanded by the explosion and the propellant's expanding gases, such that the pellets, powder, or fluid will be ejected in a wide distribution about the grenades center—against the desired targets, and (l) the ignition by-products are contained within the flexible multipocket.

2. The non-lethal grenade of claim 1, wherein said central cylindrical section has a center point and wherein said wide distribution is an arc-of-rotation greater than about 300 degrees spherically about said center point.

3. The non-lethal grenade of claim 1, wherein said pellets are selected from the group consisting of solid balls and hollow marking balls.

4. The non-lethal grenade of claim 1, wherein said rigid internal frame is manufactured from aluminum, or magnesium, or alloys thereof, or plastics.

5. The non-lethal grenade of claim 1, wherein said flexible multipocket form is manufactured from silicone, a thermoset rubber, an impermeable woven fabric, or of a thermoplastic elastomer.

* * * * *